United States Patent [19]

Kitrilakis et al.

[11] 4,168,655

[45] Sep. 25, 1979

[54] POWER OUTPUT CONTROL SYSTEM FOR VAPOR ENGINE

[75] Inventors: Sotiris Kitrilakis, Newtonville; Edward F. Doyle, Dedham, both of Mass.

[73] Assignee: Thermo Electron Corporation, Waltham, Mass.

[21] Appl. No.: 6,843

[22] Filed: Jan. 29, 1970

Related U.S. Application Data

[63] Continuation-in-part of Ser. No. 713,983, Mar. 18, 1968, abandoned.

[51] Int. Cl.[2] ..... F01L 21/02; F01L 15/16; F01L 25/04

[52] U.S. Cl. ..... 91/240; 91/273; 91/325; 91/402; 91/243

[58] Field of Search ..... 91/402, 272, 271, 273, 91/401, 325, 240, 243, 410

[56] References Cited

U.S. PATENT DOCUMENTS

| | | | |
|---|---|---|---|
| 562,039 | 6/1896 | Schmidt . | |
| 648,820 | 5/1900 | Wetzel . | |
| 726,334 | 4/1903 | Nelson . | |
| 734,533 | 7/1903 | Fouts | 91/243 |
| 1,067,613 | 7/1913 | Lane | 91/271 |
| 1,344,126 | 6/1920 | Gates . | |
| 1,616,667 | 2/1927 | Peltzer . | |
| 1,690,410 | 11/1928 | Hudson . | |
| 2,588,478 | 3/1952 | Brown et al. | 91/325 |
| 2,671,434 | 3/1954 | Schmiedeskamp | 91/273 |
| 3,279,326 | 10/1966 | Harvey et al. . | |
| 3,361,036 | 1/1968 | Harvey et al. | 91/401 |
| 3,397,619 | 8/1968 | Sturtevant | 91/402 |

FOREIGN PATENT DOCUMENTS

| | | |
|---|---|---|
| 60534 | 7/1898 | Canada . |
| 154907 | 4/1914 | Canada . |
| 376981 | 10/1938 | Canada . |
| 463500 | 3/1950 | Canada . |
| 113234 | 9/1900 | Fed. Rep. of Germany . |
| 353207 | 5/1922 | Fed. Rep. of Germany . |
| 425426 | 2/1926 | Fed. Rep. of Germany . |
| 944131 | 7/1956 | Fed. Rep. of Germany . |
| 926973 | 10/1947 | France . |
| 7-100443 | 12/1932 | Japan . |
| 19-165083 | 7/1944 | Japan . |
| 22-175717 | 10/1947 | Japan . |
| 44-3888 | 2/1969 | Japan . |
| 616298 | 1/1949 | United Kingdom . |

*Primary Examiner*—Paul E. Maslousky
*Attorney, Agent, or Firm*—James L. Neal; Herbert E. Messenger

[57] ABSTRACT

A vapor engine including a cylinder in which a piston reciprocates and having an inlet valve in the cylinder head which is driven from its seat by the piston as it approaches the cylinder head. The time at which the valve is driven from its seat does not change relative to the top dead center position of the piston. The travel of the valve body is ballistic and the valve remains open for a time determined by a combination of the piston velocity at the initial contact, the distance the valve travels before hitting a stop from which it rebounds elastically toward its seat, the pressure drop across the valve and the mass of the valve. The exhaust valve of the engine may be either internal and actuated by mechanical forces or external, in which case it is actuated by pressure forces. In one embodiment of the invention the stop from which the valve rebounds may be adjustably positioned manually or automatically to control the period of time during which the intake valve is open.

7 Claims, 9 Drawing Figures

POWER OUTPUT CONTROL SYSTEM FOR VAPOR ENGINE

This application is a continuation in part of an application of the same applicants entitled Power Output Control System For Vapor Engine, Ser. No. 713,983, filed Mar. 18, 1968, now abandoned.

As is explained in that application, closed-cycle power plants in which the working fluid is continuously recirculated are very well known in the art. Growing concern with environmental factors such as air pollution have led to intensive restudy of such power plants. Recognition of problems which existed in the past has brought about a number of interesting and potentially valuable developments. One of these is found in U.S. Pat. No. 3,279,326, granted to Harvey et al on Oct. 18, 1966 for Steam Engine With Self-Contained Valvular Mechanism. In that patent, there is disclosed apparatus in which the intake and exhaust valve actuating means are carried by the piston and the intake mechanism is operated resonantly.

In the application of which this is a continuation-in-part, there is disclosed a valving system which includes a resilient support for the intake valve striker. In that application, the advantages of ballistic operation of the inlet valve of a vapor engine are noted. The present application is concerned with a similar vapor engine in which the inlet valve is completely and uniquely operative on a ballistic basis. The term "ballistic" is used in this description to describe the free flight of the inlet valve after it is knocked from its seat. The valve body travels ballistically away from the crown of the piston until it strikes a stop from which it rebounds elastically to reseat itself. The elastic rebound of the valve body may also be described as a mechanical reflection or reversal of direction of the travel of the valve body without loss of energy.

The invention will best be understood by a consideration of the following detailed description, which should be read in connection with the annexed drawings of a preferred embodiment thereof, in which.

Figure 1:
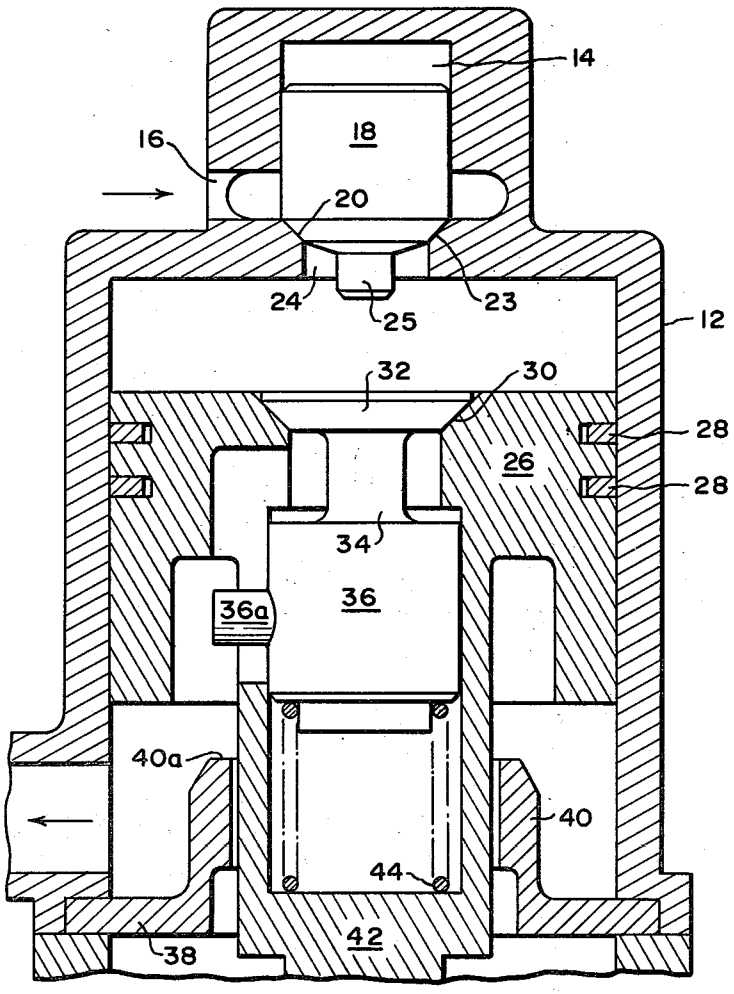
FIG. 1 is a fragmentary sectional view of a vapor engine incorporating internal valving mechanism the piston being shown at the power stroke.
Figure 4:
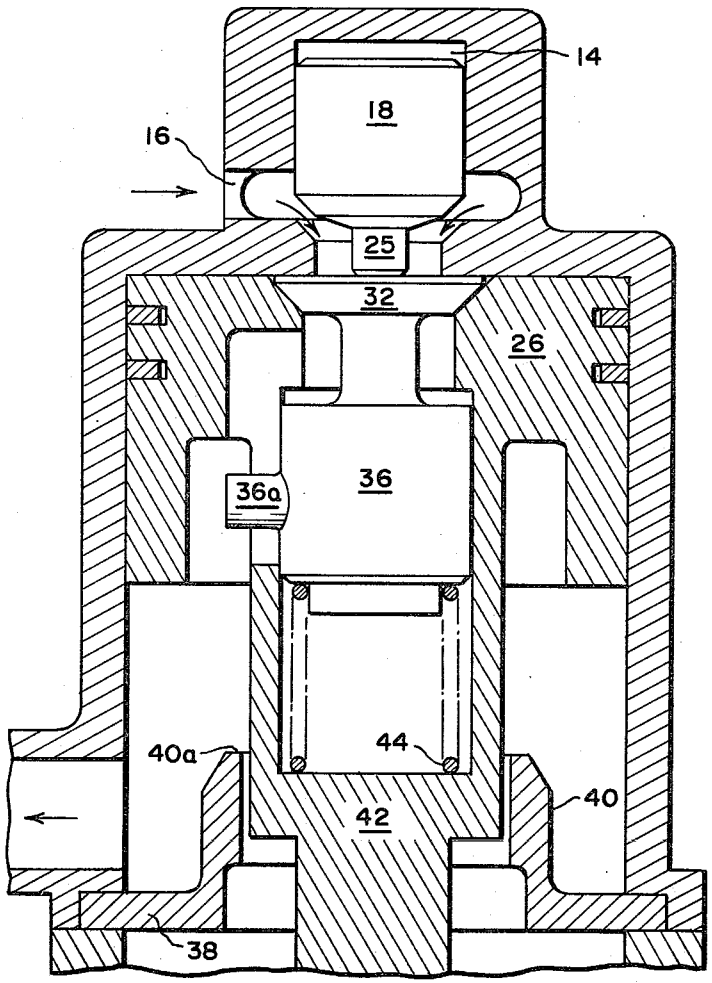
FIG. 4 is a view of the system of FIG. 1 but indicating the closing of the exhaust valve.
Figure 3:
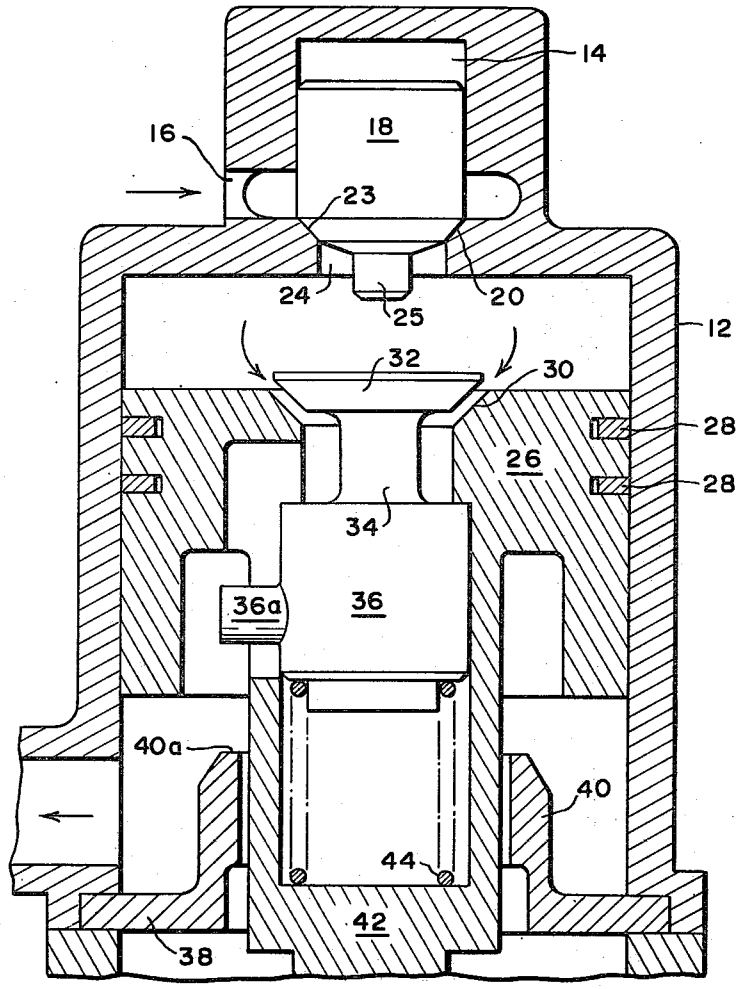
FIG. 3 is a view similar to that of FIG. 1 but indicating the return stroke of the piston.

In FIG. 1 there may be seen the cylinder 12 of a vapor engine in the head of which a valve cage and intake chamber 14 are formed. As in the previously-mentioned application of the same inventors, a boiler, not shown, is provided to generate vapor under pressure to operate the engine of the invention. The inlet for vapor under pressure to reach the intake chamber is generally designated at 16 in the form of a radial opening leading to an annular space formed in the cylinder head.

The cylindrical wall and top of the chamber and valve cage 14 contain a valve body 18 designed to reciprocate therein. The valve has a tapered lower surface 20 normally seated upon a matching tapered surface 23 formed on the wall of an opening 24 in the cylinder head. The valve body 18 has an extension 25 of smaller diameter than its major portion which protrudes downwardly and centrally in the opening 24. The extension 25 may be integral with the body 18 or solidly fixed therein, but it is desirable that it have the same characteristics as the valve body 18. The top of the valve cage chamber 14, in this version of the invention, is a solid wall which serves as a stop to limit upward travel of the valve body 18 and to elastically bounce the valve back into a seated position as is explained in greater detail below.

Within the cylinder 12 is a reciprocable piston 26 in which circumferential grooves may be formed to accommodate piston rings 28. Centrally, in the crown of the piston 26 valve port opening is formed with a tapered wall forming a seat 30. A valve body having a flat upper surface which normally forms a portion of the piston crown has a tapered periphery 32 which matches the tapered seat 30, the two tapered surfaces cooperating to provide outlet valving action. Clearance about the valve, when open, exists by reason of the reduced diameter of the valve stem or neck 34, the neck being integral with the upper valve portion and a lower valve body 36. Carried on the valve body 36 is a projection 36*a* extending radially outward.

At the base of the cylinder 12 a cross member 38 supports an exhaust valve striker 40. A piston rod 42, hollowed out at its upper end, contains a compression spring 44. The spring 44 normally exerts a biasing pressure between the solid portion of the piston rod and the bottom surface of the valve body 36, on which a ledge may be formed to center the spring 44.

Figure 2:
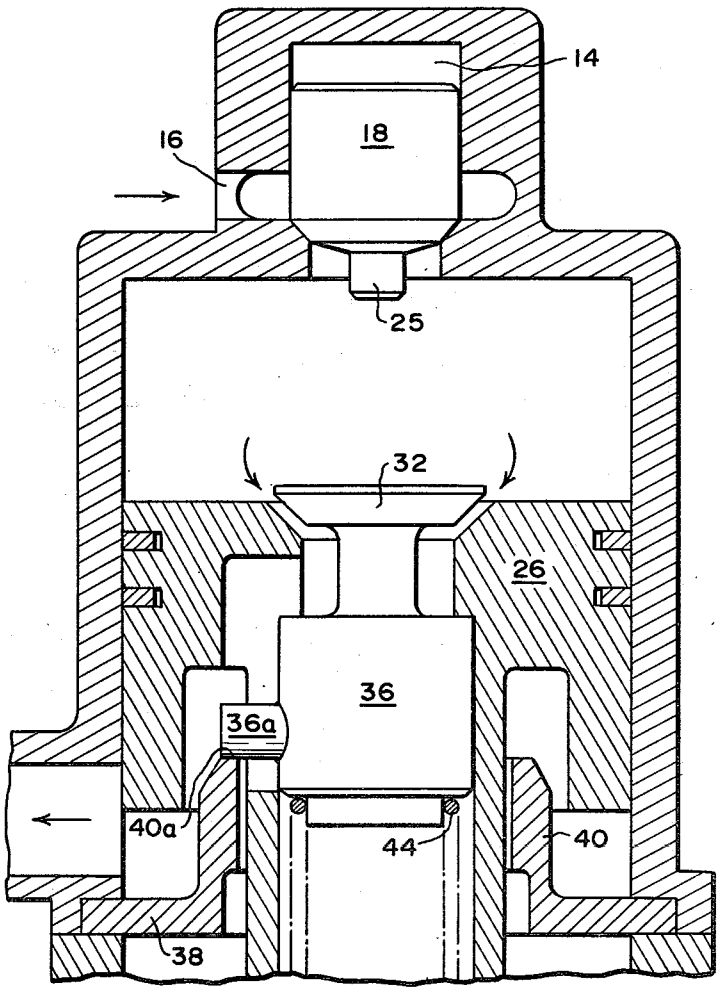
FIG. 2 is a view similar to that of FIG. 1 but indicating the opening of the exhaust valve of the engine.

FIGS. 1–4 are all sectional views of the same device. However, FIG. 1 illustrates the power stroke of the piston 26 which takes place after vapor under pressure has been admitted through the inlet 16. During this stroke, of course, the exhaust valve 32 is held closed against the pressure of the spring 44 by the pressure of the incoming vapor. In FIG. 2, the piston 26 is shown just prior to reaching bottom dead center. At this point, the exhaust valve 32 in opened by interference between the top IG. 3, during the return stroke of the piston the valve is held open by the action of the compression spring 44. Prior to the piston reaching top dead center, the top surface of the exhaust valve 32 encounters the protrusion 25 on the intake valve. Because the input pressure against the intake valve 20 is relatively high, the first action to occur when the exhaust valve 32 encounters the protrusion 25 is the closing of the exhaust valve 32. Immediately thereafter, however, as the valve 32 seats, the piston presents an unbroken solid surface or crown and the valve body 18 is driven upwardly, the closed exhaust valve acting as a striker plate. The speed of the piston is such, and the closing of the valve 32 is almost instantaneous, with the result that a sharp blow is delivered to the valve 18 causing it to fly upwardly in free flight, that is, ballistically. This occurs just before the piston reaches top dead center and the valve remains open for a period of time depending upon a combination of factors, namely the initial contact velocity between the two interferring elements, the distance the inlet valve 18 travels before striking the top of the chamber in which it is caged before it rebounds elastically without loss of energy to its seat, the pressure drop across the valve and its mass.

During the period between the driving open of the inlet valve just before top dead center and its reseating, a slug of vapor under pressure is admitted to drive the piston downwardly out of the way of the extension 25 and to initiate another cycle of operation. Of course, the extension 25 could be a part of the piston crown rather than of the valve body 18 to achieve similar results, but, for reasons of structural simplification the illustrated and described mechanism is preferred.

In FIGS. 5–8, the embodiment of the invention in which external valving is used is illustrated. In this instance, it is the top of the piston itself which serves to knock the inlet valve out of its seat and permit the ingress of vapor under pressure. FIGS. 5–8 are in the same order as the figures of the drawing of the internal exhaust valve mechanism discussed above.

Figure 5:
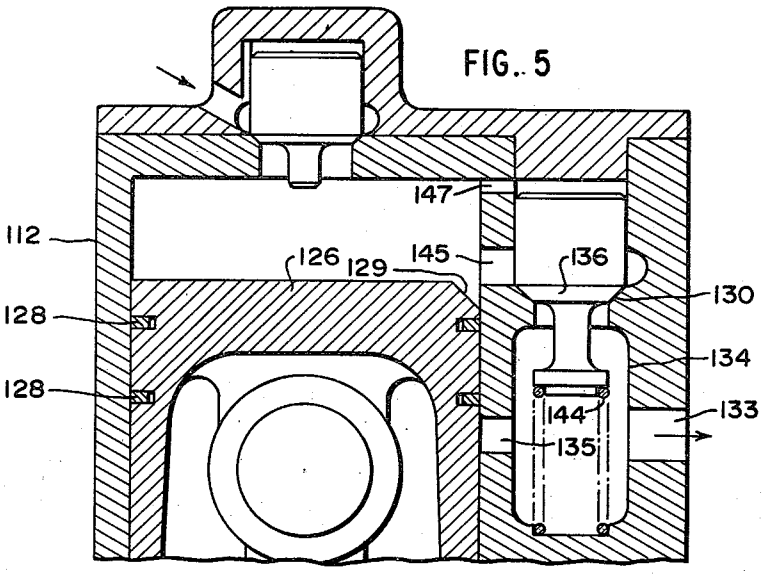
FIG. 5 is a view of an alternative embodiment of the vapor engine of FIG. 1 in which external valving is used, the piston being shown at the power stroke.

FIG. 5 illustrates the engine during the power stroke which takes place following the action of the inlet valve. In that view, it may be seen that external valving is utilized for the exhaust system. However, as in the previously described embodiment, a piston 126, having circumferential grooves which carry piston rings 128 reciprocates in the cylinder 112.

Because the valving is external relative to the major cylinder 112, it is possible to utilize a wrist pin disposed within the hollow piston for power output connections. The piston itself may differ slightly from that previously described in that it has a chamfer 129 about at least a portion of its crown. The inlet valve and its caging as well as the inlet line for vapor under pressure may be substantially identical to those of the previously described embodiment and need no further description. The external exhaust system includes a secondary or exhaust valve cylinder 134 adjacent the major cylinder 112 and containing a generally spool-shaped exhaust valve 136 which is biased from the bottom of the secondary cylinder 134 by a compression spring 144 bearing upon the under surface of the valve body. Two passages or ports 145 and 147 connect the major cylinder with the exhaust valve cylinder at points above the tapered seat of the valve 136. An enlarged cylindrical volume is formed about and above the valve seat 130 in the cylinder at the intersection of the passage or port 145. Immediately below the valve seat 130 the exhaust valve cylinder is reduced in internal diameter for a short distance. The valve 136 has a tapered surface 131 about its lower periphery which matches the tapered surface of the valve seat 130. An external exhaust passage or port 133 is formed in the outer wall of the exhaust valve cylinder, and opposite that port, still another passage or port 135 provides further communication between the major cylinder and the exhaust valve cylinder.

Figure 6:
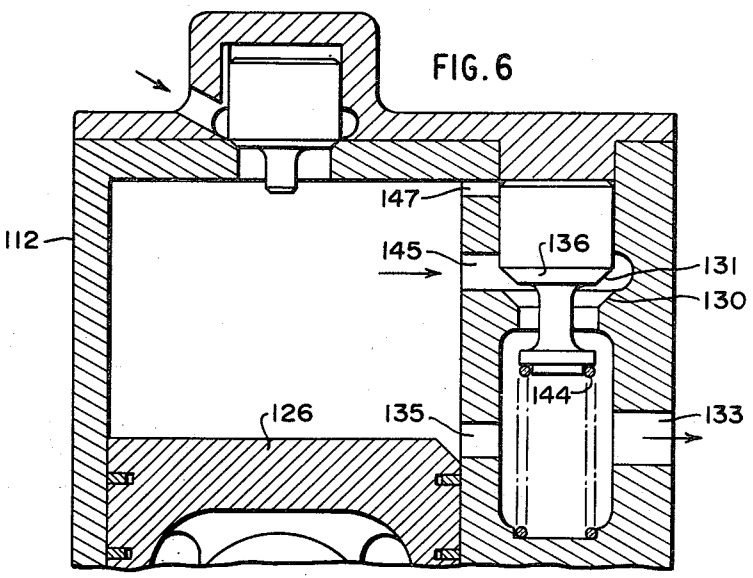
FIG. 6 is another view of the engine disclosed in FIG. 5 showing the opening of the exhaust valve.
Figure 8:
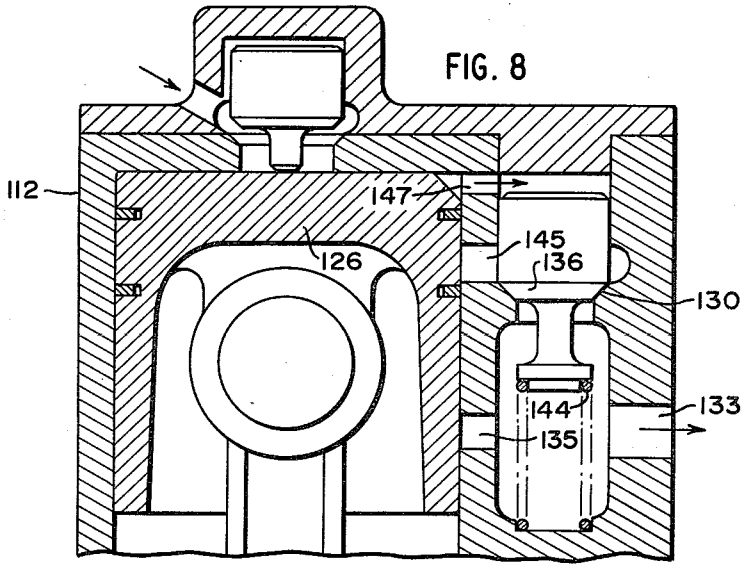
FIG. 8 is a view showing the closing of the exhaust valve of the engine of FIG. 5.
Figure 7:
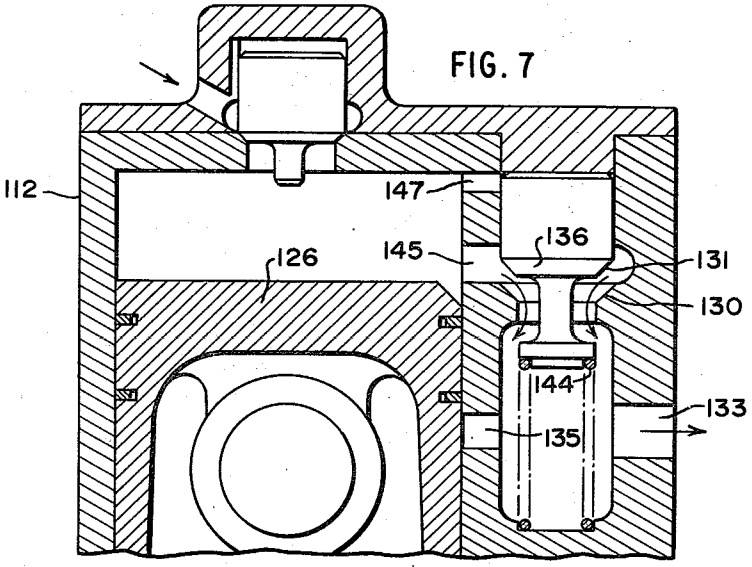
FIG. 7 is a view showing the return stroke of the piston of the engine of FIG. 5.

On the power stroke, as illustrated in FIG. 5, a slug of vapor under pressure has been admitted, the exhaust valve 136 being closed, and the piston has been driven to a point below the communicating port 145. In FIG. 6, the piston is approaching bottom dead center at which point it clears the exhaust port 135 to exhaust most of the working fluid from the cylinder. As that pressure drops, however, it reaches a point at which pressure across the exhaust valve 136 is equalized and the compression spring 144 opens the exhaust valve 136 as may be seen in FIG. 6. Thus, during the return stroke, as shown in FIG. 7 the piston exhausts the cylinder 112 principally through the port 145, the valve 136 and the port 133. However, as the piston rises toward top dead center to close the port 145, as seen in FIG. 8, the residual vapor is forced through the port 147 to close the exhaust valve 136, the chamfer 129, when incorporated, aiding this action. The residual vapor is recompressed then to a pressure equal to that of inlet vapor pressure before the inlet valve is opened. Thus, no throttling occurs when the inlet valve is opened.

Now, the inlet valve is knocked from its seat by the upward movement of the piston to initiate a repetition of the cycle. As in the previously described embodiment, a slug of vapor enters the cylinder during the period of time the inlet valve is open and the piston is driven downwardly.

Figure 9:
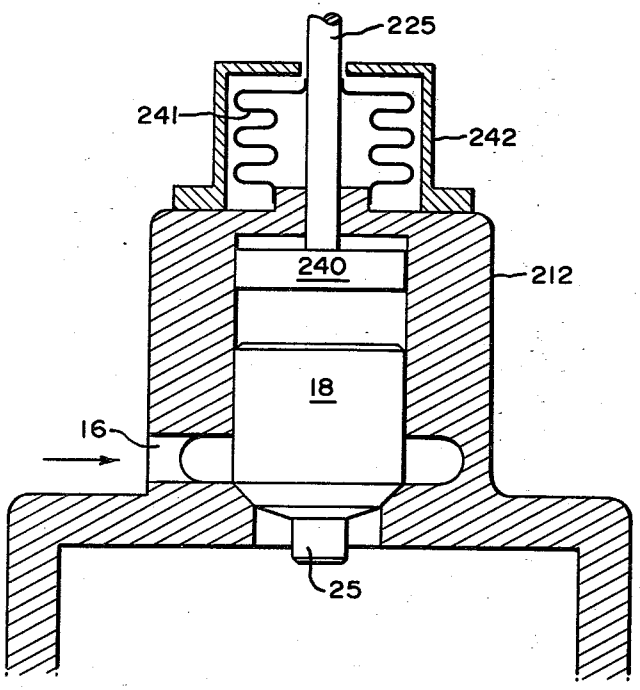
FIG. 9 is a fragmentary view of a variation of the vapor engine of FIG. 1 in which an adjustable stop is provided.

It is possible to adjust the period of time the intake valve is open even while the engine is running. This can be accomplished by incorporating an adjustable valve return stop or striker as shown in FIG. 9 as a modification of the basic intake valve design.

In this embodiment, an opening is formed through the top of the engine head chamber to accommodate a rod 225. Attached to or integral with the rod 225 is a stop or striker 240, vertically movable in the chamber and forming, in effect, an adjustable chamber top. A metal bellows is sealed to the rod 225 and to a shoulder 227 formed on the outer chamber top to provide a hermetic barrier. A protective cover 242 also having an opening to accommodate the rod 225 may also be utilized. The distance between the valve 118 and return stop or striker 240 can be adjusted by moving the rod 225. This can be accomplished manually or by either a mechanical or hydraulic automatic actuating system.

Movement of the rod 225 and its return striker 240 away from the intake valve 118 increases the distance the valve must travel before rebounding from the return striker and results in the intake valve being open for a longer period of time before it reseats and cuts off the flow of vapor to the cylinder. The action of the device is to provide a variable period of time during which the intake valve is open, variable cut-off intake valve action being thus obtained.

The exhaust valve systems of the invention have been operated in various sizes of cylinders and with various working fluids including steam, a commercially available working fluid, Monsanto CP-34 and a commonly used refrigerant R-22. Efficient performance at running speeds of up to 3600 rpm has been achieved.

In all embodiments of the invention, no springs or other vulnerable devices are employed in the high heat-high pressure inlet regions. In the adjustable version of the invention, there is no change in the time of opening of the inlet valve, it taking place at the same time relative to piston position as the piston approaches top dead center. Only the closing time of the inlet valve is changed by movement of the stop from which the inlet valve body rebounds in its ballistic flight.

Engines incorporating features of the present invention have been made in a range of sizes from fractional to multi-horsepower units. The basic ballistic valving concept has been successfully embodied in all of the units, performance equaling or exceeding expectations.

What is claimed is:

1. In a vapor engine which includes a cylinder having a head and a piston reciprocable in said cylinder relative to said head in response to vapor under pressure, the combination of inlet valve apparatus comprising means forming a chamber and inlet valve cage in said head, an inlet valve body disposed in said chamber and reciprocable in the same directions as said piston, an inlet port to the interior of said cylinder being formed at one end of said chamber, said inlet valve body normally closing said inlet port, an extension formed on said inlet valve body and protruding into said inlet port, said extension being disposed in the path of reciprocation of said piston whereby said inlet valve body is knocked from said port by said piston as said piston approaches top dead center adjacent said head, whereby said inlet port is opened to admit said vapor under pressure to said cylinder to cause reversal of direction of reciprocation of said piston, said inlet valve body traveling ballistically from said inlet port and rebounding elastically from the top of said chamber to reseat in said inlet port as said piston moves away from said head, and normally closed exhaust valve apparatus operative to release vapor from said cylinder as said piston moves a predetermined distance from said head, said exhaust valve apparatus comprising a secondary cylinder disposed adjacent said cylinder, means forming an exhaust valve port and seat in said secondary cylinder, an exhaust valve body disposed in said exhaust valve port, resilient means normally biasing said exhaust valve body out of said exhaust valve seat, said secondary cylinder having an opening to the outside atmosphere formed in its wall below said exhaust valve seat, said cylinder and said secondary cylinder being in communication by means of three spaced passages formed through the walls thereof, the first of said passage being adjacent said head, and above said exhaust valve seat the third passages being adjacent but above said exhaust valve seat and the second of said passages being at a point below said valve seat and remote from said head by substantially said predetermined distance, whereby the bulk of exhaust vapor passes through said second passage and said outside opening as said piston reaches said point, residual exhaust vapor being exhausted through said third and first passages as said piston returns toward said head until said piston passes and thereby blocks said third passage, final residual vapor passing only through said first passage to force said exhaust valve body into said exhaust valve seat as said piston approaches top dead center.

2. In a vapor engine having a main cylinder one end of which is closed by a head and a piston reciprocable in said cylinder between a first position adjacent said head and a second position remote from said head, the combination therewith comprising:

a valve cage formed in said head, said valve cage defining an elongated inlet chamber having an inlet port to said cylinder at one end of said chamber adjacent said cylinder and including stop means at the opposite end of said chamber;

an inlet valve body having a shape closely conforming to the shape of said inlet chamber, said valve body being reciprocable in said inlet chamber between said inlet port and said stop means, said valve body normally closing said inlet port; an inlet passage through a wall of said valve cage near the end of said elongated chamber adjacent said cylinder means for ballistically driving said inlet valve body from said inlet port as said piston approaches said first position and causing said valve body to travel in free flight from said inlet port to impact against said stop means;

said stop means operable upon impact of said inlet valve body to elastically bounce said inlet valve body into free flight for travel to and reclosure of said inlet port as said piston moves toward said second position;

exhaust valve apparatus; and means for opening said exhaust valve apparatus as said piston moves toward said second position.

3. In a vapor engine as defined in claim 2, the combination wherein said means for driving said inlet valve body from said inlet port and causing said valve body to travel in free flight from said inlet port to impact against said stop means comprises an extension formed on said valve body and disposed in the path of said piston as said piston approaches said first position.

4. In a vapor engine as defined in claim 3, the combination wherein said extension protrudes through the head of said cylinder and is contacted by a portion of the crown of said piston as said piston approaches said first position.

5. In a vapor engine as defined in claim 2, the combination wherein said valve cage further includes means for varying the distance between said stop means and said inlet port.

6. In a vapor engine having a main cylinder one end of which is closed by a head and a piston reciprocable in said cylinder between a first position adjacent said head and a second position remote from said head, the combination of an inlet chamber and valve cage formed in said head, a normally closed inlet valve reciprocable in said cage, means comprising an extension formed on the body of said valve and disposed in the path of said piston as said piston approaches said first position for causing said inlet valve to be ballistically driven toward the top of said cage to open said valve as said piston approaches said first position, said inlet valve bouncing elastically from the top of said cage to reclose as said piston moves toward said second position, exhaust valve apparatus, and means for opening said exhaust valve apparatus as said piston moves toward said second position, said exhaust valve apparatus comprising a second cylinder, an exhaust valve reciprocable in said second cylinder, a plurality of ports being formed between said cylinders, means normally urging said exhaust valve open, a first of said ports permitting residual vapor under pressure to leave said main cylinder and reach said second cylinder to close said exhaust valve as said piston approaches said first position, a second of said ports permitting the bulk of exhaust vapor to bypass said exhaust valve and be exhausted from said main cylinder to said second cylinder as said piston approaches said second position said means urging said exhaust valve open becoming operative to open said exhaust valve as said bulk of said vapor under pressure is exhausted through said second port, said third of said ports permitting vapor to continue to be exhausted through said exhaust valve as said piston leaves said second position and commences its return to said first position.

7. In a vapor engine which includes a cylinder having a head and a piston reciprocable in said cylinder relative to said head in response to vapor under pressure, the combination of inlet valve apparatus comprising means forming a chamber and inlet valve cage in said head, an inlet valve body disposed in said chamber and reciprocable in the same directions as said piston, an inlet port to the interior of said cylinder being formed at one end of said chamber, said inlet valve body normally closing said inlet port, an extension formed on said inlet valve body and protruding into said inlet port, stop means along said chamber spaced from and facing the portion of said inlet valve body opposite said extension, said extension being disposed in the path of reciprocation of said piston whereby said inlet valve body is knocked from said port by said piston as said piston approaches top dead center adjacent said head and travels in free flight from said inlet port to said stop means from which said inlet valve body rebounds elastically without substantial loss of energy and continues in said free flight for reseating in said inlet port, whereby said inlet port is opened to admit said vapor under pressure to said cylinder to cause reversal of direction of reciprocation of said piston as said inlet valve body travels from said inlet port to said stop means and rebounds elastically from said stop means for reseating in said inlet port, and normally closed exhaust valve apparatus operative to release vapor from said cylinder as said piston moves a predetermined distance from said head.

* * * * *